US006964506B2

(12) United States Patent
Sara et al.

(10) Patent No.: US 6,964,506 B2
(45) **Date of Patent: *Nov. 15, 2005**

(54) LIGHT REFLECTOR

(75) Inventors: Peter C. Sara, Vista, CA (US); Steven C. Donner, San Diego, CA (US); Henry M. Avila, Palmdale, CA (US)

(73) Assignee: Allied Lighting Systems, INC, San Diego, CA (US)

( * ) Notice: Subject to any disclaimer, the term of this patent is extended or adjusted under 35 U.S.C. 154(b) by 36 days.

This patent is subject to a terminal disclaimer.

(21) Appl. No.: 10/461,757

(22) Filed: Jun. 14, 2003

(65) Prior Publication Data

US 2003/0214811 A1 Nov. 20, 2003

Related U.S. Application Data

(63) Continuation of application No. 10/117,420, filed on Apr. 4, 2002, now Pat. No. 6,582,101, and a continuation-in-part of application No. 09/694,721, filed on Oct. 23, 2000, now Pat. No. 6,508,574.

(51) Int. Cl.[7] ..... F21V 7/00

(52) U.S. Cl. ..... 362/518; 362/297; 362/310; 362/346; 362/347; 362/291; 362/517; 362/518; 362/290

(58) Field of Search ..... 362/518, 297, 362/310, 346, 347, 291, 517, 290

(56) References Cited

U.S. PATENT DOCUMENTS

| | | | | |
|---|---|---|---|---|
| 270,339 A | | 1/1883 | Ritchie | |
| 1,546,281 A | | 7/1925 | Brown | |
| 2,035,215 A | | 3/1936 | Bean | |
| 2,111,085 A | | 3/1938 | Arras | |
| 2,369,894 A | | 2/1945 | Hallman et al. | |
| 3,265,883 A | | 8/1966 | Tolbert | |
| 4,451,875 A | | 5/1984 | Odle et al. | |
| 4,488,205 A | | 12/1984 | Quiogue | |
| 5,938,317 A | * | 8/1999 | Thornton | 362/290 |
| 6,152,579 A | | 11/2000 | Reed et al. | |
| 6,582,101 B2 | * | 6/2003 | Sara et al. | 362/297 |

OTHER PUBLICATIONS

Holophane Mongoose™ Architectural Luminaire brochure, dated Dec. 1999.

Hydrel 7200 Series Architectural Lightning System brochure, dated Mar. 1999. See specifically pp 4. (Horizontal Flood) and 6 (Downlight, Forward Wide and Downlight, Symmetrical). For this same series of fixtures. Hydrel 7100/7200 Series, see also the drawings that show the Hydrel 7100 Series, developed in approximately 1992, and the Hydrel 7200 Series, developed in approximately 1994.

(Continued)

*Primary Examiner*—Sandra O'Shea
*Assistant Examiner*—Bertrand Zeade
(74) *Attorney, Agent, or Firm*—Jerry R. Potts

(57) ABSTRACT

A light reflector having a row of light reflecting segments separated by fold lines, wherein one segment is located at a top of the row and another segment is located at a bottom of the row. A pair of wings is connected at the sides of the row, each one of the wings including a plurality of light reflecting segments separated by fold lines, wherein at least some of the light reflecting segments of the row and at least some of the light reflecting segments of the wings form a shell-shaped arrangement wherein at least some light reflecting segments of the row and at least some light reflecting segments of the pair of wings are bent at their respective fold lines whereby the arrangement is generally curved along an imaginary line connecting the one segment and the another segment and generally curved along an imaginary line perpendicular to the first mentioned line.

40 Claims, 5 Drawing Sheets

OTHER PUBLICATIONS

Kim Lightting, $AFL^2$ Archetectural Floodlights brochure, dated Jul. 1991.
EMCO Lightning brochure, Infinette Luminaire, dated 1990.
Hydrel Hypack 4000 brochure, dated May 1993.
Moldcast, The MDL™ Series brochure, dated 1983.
Wide-Lite's Spectra® Cutoff Family brochure, dated Jun. 1979.
Holophane Mongoose™ Assembly, dated May 21, 1999.

* cited by examiner

LIGHT REFLECTOR

CROSS REFERENCE TO RELATED APPLICATIONS

This application is a continuation in part of U.S. patent application Ser. No. 09/694,721, entitled "Light Fixture", filed on Oct. 23, 2000 now U.S. Pat. No. 6,508,574 and a continuation of U.S. patent application Ser. No. 10/117,420, entitled "Light Fixture" filed on Apr. 4, 2002, now U.S. Pat. No. 6,582,101. Said patents incorporated herein by reference as though fully set forth.

FIELD OF THE INVENTION

The present invention relates generally to lighting apparatus and, more particularly, to light reflectors suitable for use in fixtures intended for use in illuminating outdoor signs.

BACKGROUND OF THE INVENTION

Surface illuminating devices are well known. For example, light fixtures are used in many indoor applications, such as museums, to illustrate paintings and other art objects. The demands placed on the light reflectors in such devices are sometimes less stringent than on those utilized in outdoor applications. In this regard, the light reflectors utilized in fixtures for illuminating highway signs must satisfy more rigorous criteria.

Thus, while limitations of a light reflector in an indoor setting may cause inconvenience, functional limitations in a highway lighting fixture can have serious safety implications for both motorists and maintenance crews. For example, to limit motorist confusion, it is important that highway signs be adequately and uniformly lighted.

Maintenance, installation and replacement are also important considerations. A sturdy, lightweight reflector can make it safer for a maintenance crew to install and replace it, especially in dangerous highway locations.

Thus, it would be desirable to have a light reflector, adapted for use in highway sign lighting fixtures, that can illuminate the sign surface in a generally uniform manner while being sturdy in structure and lightweight. Ideally, such a light reflector would be low in cost to manufacture, being constructed of readily available materials.

DISCLOSURE OF THE INVENTION

According to the present invention, there is provided a light reflector having a row of light reflecting segments separated by fold lines, wherein one segment is located at a top of the row and another segment is located at a bottom of the row. A pair of wings is connected at the sides of the row, each one of the wings including a plurality of light reflecting segments separated by fold lines, wherein at least some of the light reflecting segments of the row and at least some of the light reflecting segments of the wings form a shell-shaped arrangement wherein at least some light reflecting segments of the row and at least some light reflecting segments of the pair of wings are bent at their respective fold lines whereby the arrangement is generally curved along an imaginary line connecting the one segment and the another segment and generally curved along an imaginary line perpendicular to the first mentioned line.

The light fixture embodying the present invention affords several advantages. It is inexpensive to manufacture, reliable in performance and light in weight. In addition, it enables uniform lighting of highway signage in an efficient and effective manner.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
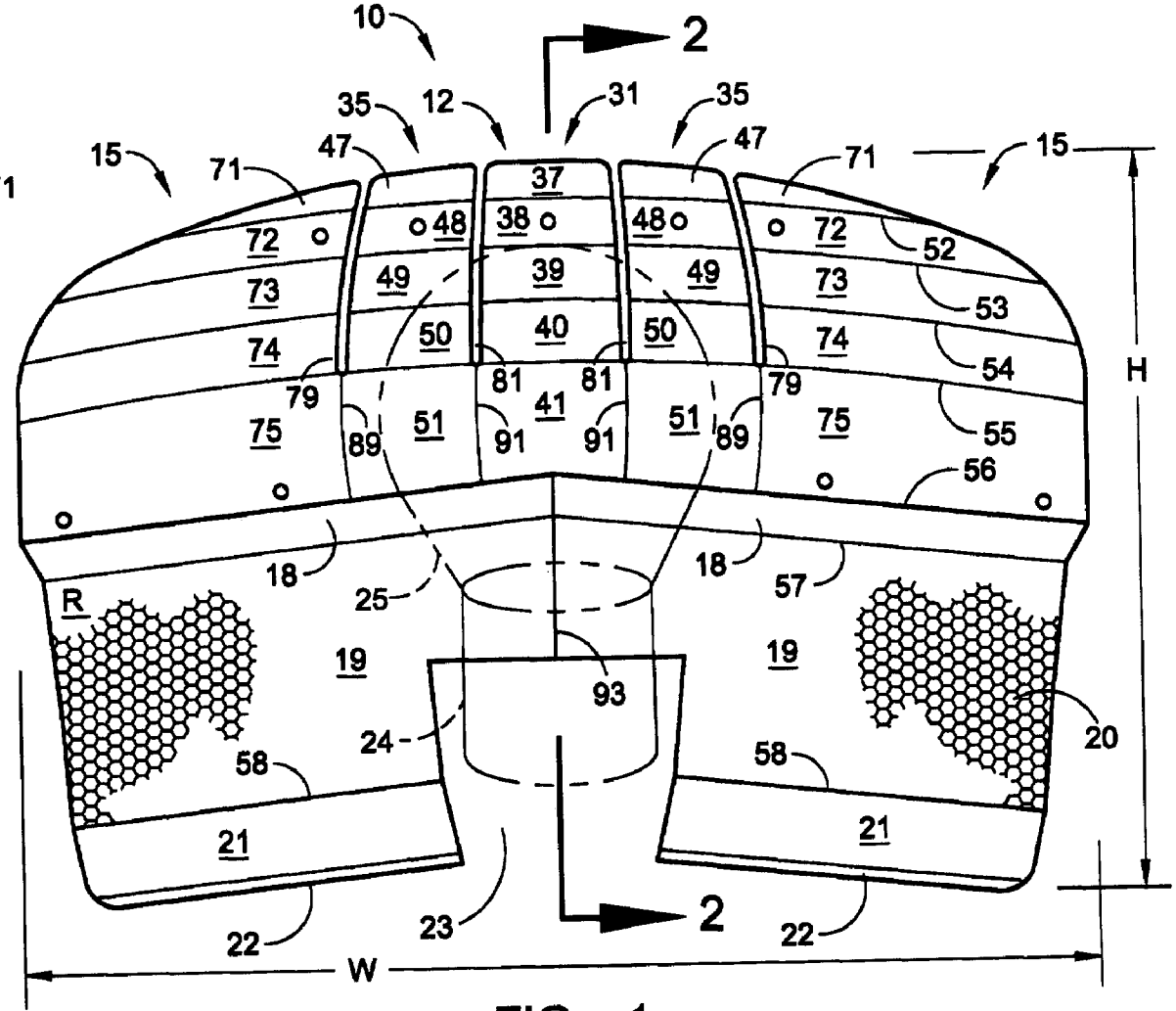
FIG. 1 is a front elevational view of an embodiment of a light reflector that is constructed according to the present invention.

Referring now to the drawings, and in particular to FIGS. 1–5 thereof, there is shown an embodiment of a novel light reflector 10 that is constructed according to the present invention. The reflector 10 includes a plurality of medially located rows, generally indicated by the reference numeral 12, of light reflecting segments. The plurality of rows 12 includes a medial row, generally indicated by the reference numeral 35, that is bracketed laterally by a pair of rows, generally indicated by the reference numeral 35. A pair of wings, generally indicated by the reference numeral 15, comprised of a plurality of light reflecting segments, laterally brackets the pair of rows 35.

A reflective plate 19 is integrally connected by a reflective riser 18 to the rows 12 and the wings 15. As shown in FIG. 1, the reflective plate 19 may have a smooth reflective surface or a hammertone finish 20. Depending from the reflective plate 19 is a pair of reflecting segments 21 to which mounting tabs 22 are integrally connected. In use, the reflector 10 is mounted to an underlying support (not shown) at the tabs 22. The reflective plate 19 and reflective segments 21 help to define an opening 23 for accommodating a lamp, indicated in phantom by reference numeral 25, and a socket 24, shown in phantom by reference numeral 24.

Figure 2:
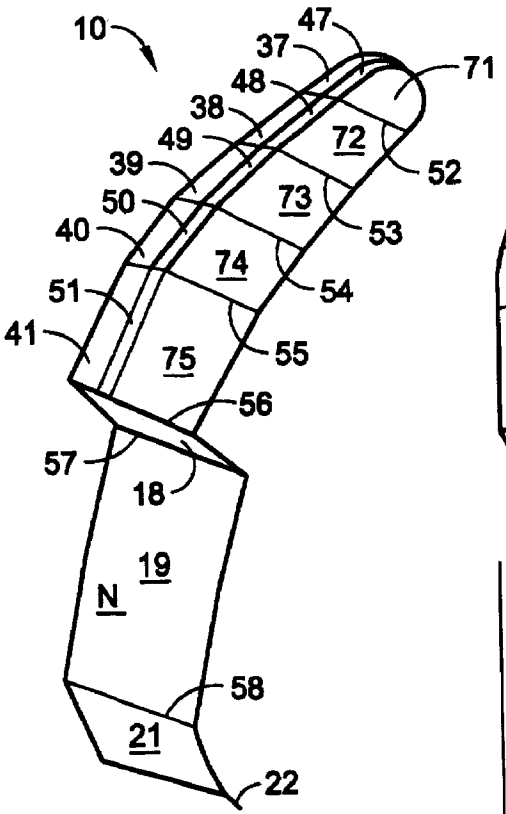
FIG. 2 is a sectional view taken along the line 2—2 of the light reflector of FIG. 1.

Referring now to FIGS. 1 and 2, the reflector 10 is constructed from a blank of sheet aluminum (FIG. 4) and includes a highly reflective surface R and a non-reflective surface N. In the embodiment shown in FIG. 1, the reflector 10 has a height H of between about 4.0 inches and about 10 inches with a preferred height of about 5.7 inches. In addition, the reflector 10 has a width W of between about 10 inches and about 20 inches with a preferred width of about 15.4 inches.

Considering now the plurality of rows 12 in further detail with reference to FIGS. 1 and 2, the plurality of rows 12 includes the medial row 31. This row includes light reflecting segments 37–41 that are integrally connected seriatum. Interposed between the segments 37–41 are fold lines 52–56, respectively. The pair of rows 35 laterally bracket the medial rows 31 and include light reflecting segments 47–51, integrally connected seriatum. Here again, fold lines 52–56, respectively are interposed between the segments 37–41. The segments are generally flat and rectangular in shape, with the exception of the segments 37 and 47, which have a generally trapezoidal configuration. The segments 51 are integrally connected at fold lines 91 to the segment 41 while the segments 37–40 are separated from the segments 47–50, respectively, by slots 81.

As mentioned, the wings 15 laterally bracket the plurality of rows 12. The wings include light reflecting segments 71–75 that are integrally connected seriatum. Interposed between the segments 71–75 are the fold lines 52–56, respectively. The segments 71–75 are generally flat and rectangular in shape, with the exception of the segments 71 which are generally wedge shaped. The segments 75 are integrally connected at fold lines 89 to the segment segments 51 while the segments 71–74 are separated from the segments 47–50, respectively, by slots 79.

Figure 4:
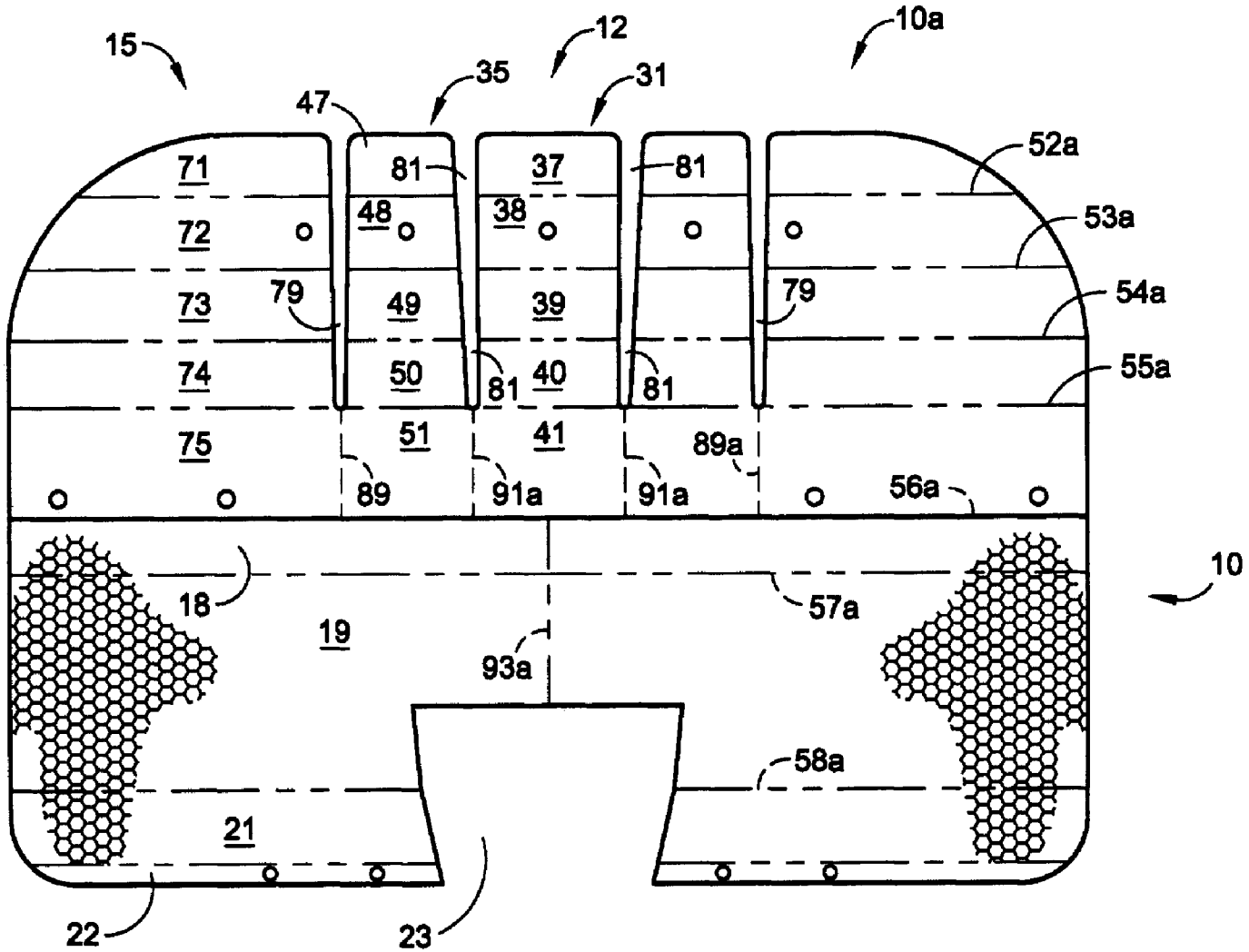
FIG. 4 is a plan view of a blank that is used to form the embodiment of the light reflector of FIG. 1.
Figure 5:
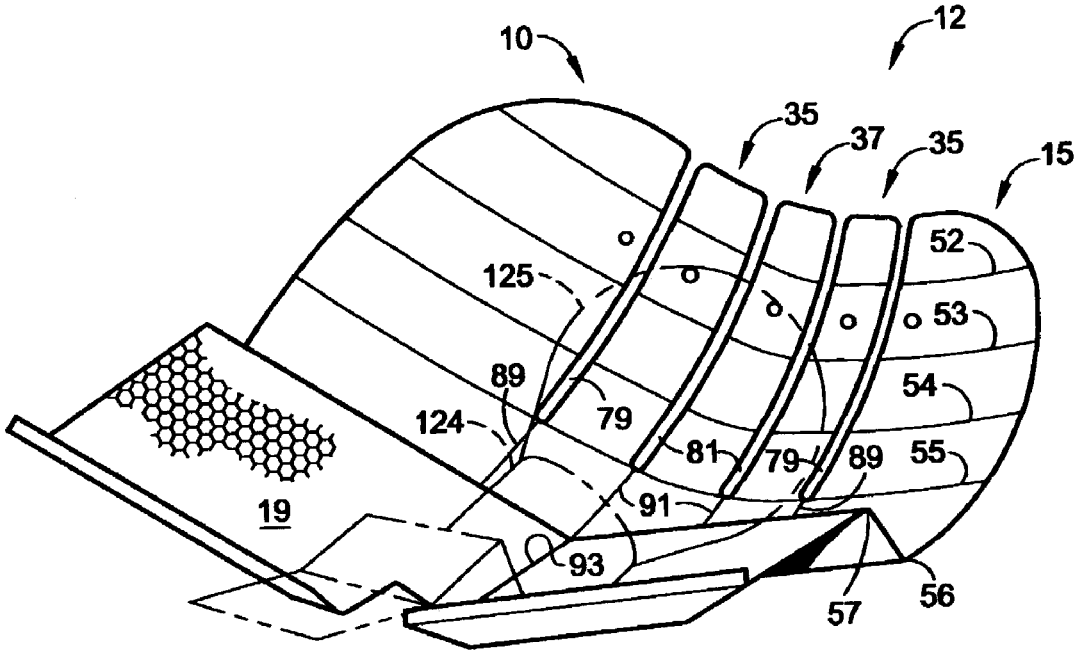
FIG. 5 is a front elevational view of the embodiment of the light reflector of FIG. 1 showing the reflector in its shell shaped configuration.

In formation of the reflector 10, a sheet metal blank 10*a*, described more fully below with reference to FIG. 4, is folded in various places to form a shell shape. As shown in FIGS. 1, 2 and 5, fold lines 37–41, 47–51, 71–75, 89 and 91 are disposed between contiguous reflective segments to enable formation of the shell configuration from substantially flat segments. In addition to the folds, the slots 79 and 81 aid in shell formation.

Referring now to FIG. 4, there is shown a blank 10*a*, composed preferably of aluminum, from which the reflector 10 is constructed. Witness lines, corresponding to respective fold lines shown in FIGS. 1, 2 and 5, are disposed throughout the blank 10*a* to aid in formation of the shell shaped reflector 10 shown in FIG. 5. Thus, where a witness line having a reference numeral ending in "a" is described, it should be noted that the witness line corresponds, respectively, to a fold line shown in FIGS. 1, 2 and 5 wherein the fold line is identified by the same reference numeral, absent the letter "a".

As shown in FIG. 4, witness lines 89*a* are located between the segments 51 and 75 and witness lines 91*a* are located between the segments 41 and 51. The slots 79 and 81 are formed in the blank 10*a*. The slots 81 partially separate the medial row 31 from the rows 35 and the slots 79 partially separate the rows 35 from the rows 15. In addition to the aforementioned slots and witness lines, horizontal witness lines, corresponding to respective fold lines of reflector 10, are also provided. In this regard, the witness line 52*a* is located between the segments 71, 47, 37 and the segments 72, 48, 38; the witness line 53*a* is located between the segments 72, 48, 38 and 73, 49, 39; the witness line 54*a* is located between the segments 73, 49, 39 and 74, 50, 40; the witness line 55*a* is located between the segments 74, 50, and 40 and the witness line 56*a* is located between the segments 75, 51 and 41, and the riser 18. In a similar manner, a witness line 57*a* is located between the riser 18 and the plate 19 and a witness line 58*a* is located between the plate 19 and the segments 21. It will be noted that a witness line 93*a* evenly divides both the riser 18 and the plate 19 into two substantially equal portions.

In forming the shell shaped configuration of the reflector 10, the various light reflective segments are bent in relation to other, contiguous segments whereby the shell-shaped structure shown in FIG. 5 is achieved. In this figure, the relationships among the light reflective segments of one of the rows 15 are shown as illustrative of the spatial relationships between segments after the shell shape has been formed.

To aid in understanding of the shell shape configuration, one may posit an imaginary line bisecting the row 31 from the uppermost, or top, light reflecting segment 37 through the lowermost segment 41. The blank 10*a* is bent about this imaginary line and, in addition, about another imaginary line perpendicular to the first mentioned imaginary line. In addition, the blank is folded along the fold lines 56 and 57 to form the riser 18 while folding along the fold line 93 results in the reflective plates 19 forming a shallow V configuration.

Figure 3:
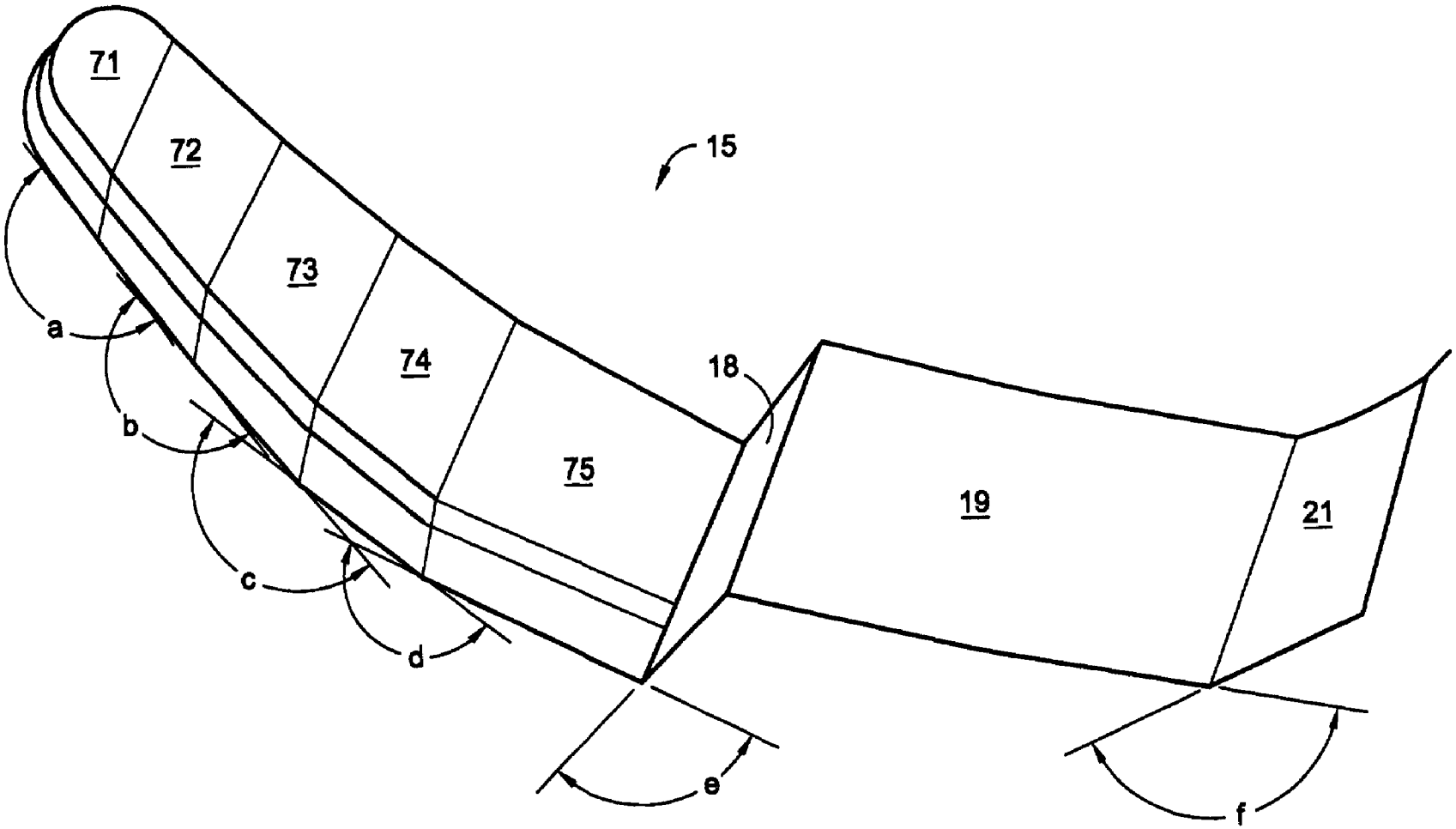
FIG. 3 is perspective view of a portion of the light reflector of FIG. 1 showing the spatial relationships among reflective segments thereof.

Referring now to FIG. 3, as the blank 10*a* is bent along the various witness lines, angles between contiguous light reflecting segments, as measured on the non-reflective side of the reflector 10, become less than 180°. In this regard, the segments 71 and 72 form an angle of between about 160° and about 179°, preferably about 179°. In a similar manner, the angle b between the segments 72 and 73 is between about 160° and 180°, preferably about 177°; the angle c between the segments 73 and 74 is between about 150° and 180°, preferably about 169°; the angle d between the segments 74 and 75 is between about 150° and 180°, preferably about 167°; the angle e between the segments 75 and the plate 19 is between about 145° and 175°, preferably about 152°; and the angle f between the plate 19 and the segment 21 is between about 140° and 160° preferably about 146°.

Figure 7:
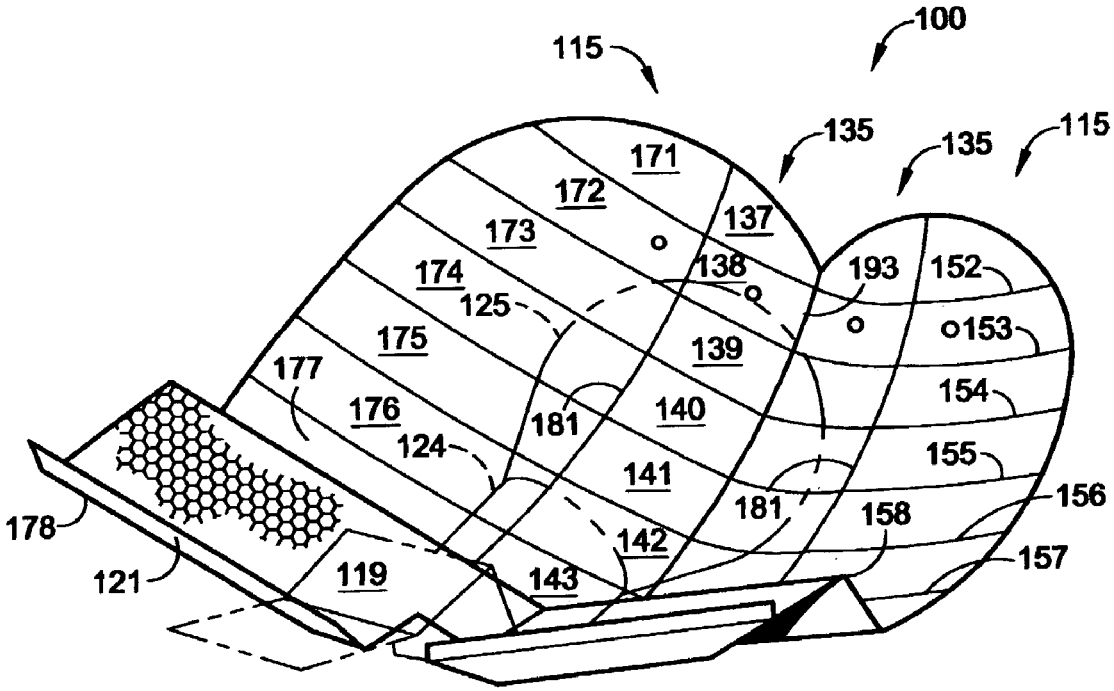
FIG. 7 is a front elevational view of the embodiment of the light reflector of FIG. 6 showing the reflector in its shell shaped configuration.
Figure 6:
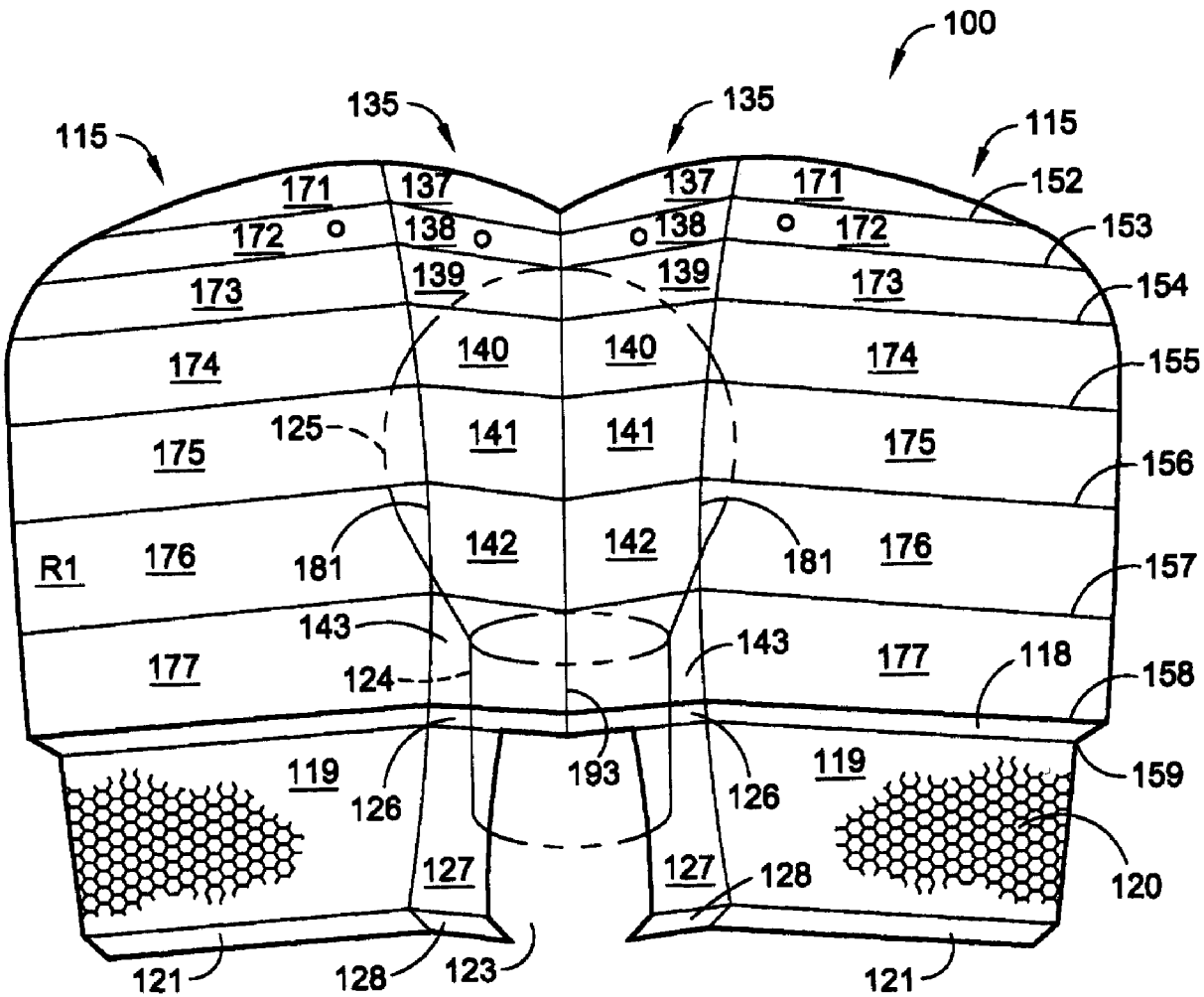
FIG. 6 is a front elevational view of another embodiment of the light fixture of the present invention.

Referring now to FIG. 6, there is shown a second embodiment of the present invention, in the form of a light reflector 100. The reflector 100 is constructed in a manner similar to that of the reflector 10, having a shell-shaped configuration, as shown in FIG. 7. The reflector 100 is divided in half by a fold line 193. Each half is comprised of medial rows 135 of light reflecting segments bracketed laterally by rows 115 which are also comprised of light reflecting segments and are separated from the rows 135 by fold lines 181.

The fold line 193 terminates at an opening 123 for accommodation of a socket and a lamp, shown in phantom by reference numerals 124 and 125, respectively 125. Bracketing the fold line 193 are reflective risers 126 and reflective segments 127. The reflector 100 includes a highly reflective surface R1 as shown in FIG. 6. The rows 135 are arranged in a shallow V-shaped configuration about the fold line 193 with the rows 135 forming the legs of the V.

The rows 115 include light reflecting segments 171–175 that are similar in form and function to their respective counterparts 71–77 of the reflector 10. In addition, the rows 115 include segments 176 and 177. A riser 118 is similar to the riser 18 and it also may have a hammertone reflective surface 120. In like manner, the rows 135 are comprised of light reflecting segments 137–141 that are similar in form and function to their reflector 10 counterparts 37–41, respectively. In addition, the rows 135 include segments 143 and 144. Mounting tabs 121 and 128 are useful for attaching the reflector 100 to an underlying structure (not shown).

Fold lines 152–159 are located between contiguous segments and function in the manner described with reference to the reflector 10. In addition, fold line 193 aids in formation of the above described V configuration.

Like the reflector 10, the reflector 100 has a shell-shaped configuration wherein a blank of aluminum is folded to produce the V and is bent about lines parallel to the fold lines 181 and 193 and about an imaginary line perpendicular to the fold line 193. In addition, the blank is folded along the fold lines 156 and 159 to form the riser 18 and the reflective plates 19.

It will be evident that there are additional embodiments and applications that are not disclosed in the detailed description but which clearly fall within the scope of the present invention. The specification is, therefore, intended not to be limiting, and the scope of the invention is to be limited only by the following claims.

What is claimed is:

1. A light reflector comprising:

a pair of spaced apart wings, each wing including a plurality of integrally connected light reflecting segments separated by fold lines; and another plurality of integrally connected light reflecting segments separated by fold lines, said another plurality of integrally connected light reflecting segments being bracketed laterally by said pair of spaced apart wings.

2. The light reflector according to claim 1, wherein said pair of spaced apart wings and said another plurality of integrally connected light reflecting segments are configured in a shell-shaped.

3. The light reflector according to claim 1, wherein said another plurality of integrally connected light reflecting segments are curved.

4. The light reflector according to claim 1, wherein said another plurality of integrally connected light reflecting segments include at least one cutout to facilitate mounting the light reflector to a light fixture.

5. The light reflector according to claim 1, wherein said another plurality of integrally connected light reflecting segments include at least one cutout to facilitate mounting a lamp adjacent to said another plurality of integrally connected light reflecting segments.

6. The light reflector according to claim 1, wherein at least some of said plurality of integrally connected light reflecting segments separated by fold lines are bent at their fold lines to form a generally curved configuration.

7. The light reflector according to claim 1, wherein said another plurality of integrally connected light reflecting segments separated by fold lines are bent at their fold lines to form another generally curved configuration.

8. A light reflector comprising:

at least one sheet of metal having a reflective surface, said at least one sheet of metal being bent to form a plurality of integrally connected light reflecting segments separated by fold lines; and said at least one sheet of metal being bracketed laterally by a pair of wings, wherein each wing includes another plurality of integrally connected light reflecting segments separated by fold lines.

9. The light reflector according to claim 8, wherein said plurality of integrally connected light reflecting segments separated by fold lines and said pair of wings are connected to one another.

10. The light reflector according to claim 9, wherein said plurality of integrally connected light reflecting segments separated by fold lines and said pair of wings are formed into a shell shaped configuration.

11. The light reflector according to claim 9, wherein at least some of said plurality of integrally connected light reflecting segments have different sizes and shapes and are bent at their fold lines to form a generally curved configuration.

12. The light reflector according to claim 11, wherein said another plurality of integrally connected light reflecting segments separated by fold lines are bent at their fold lines to form another generally curved configuration.

13. The light reflector according to claim 8, wherein said another plurality of integrally connected light reflecting segments include at least one cutout to facilitate mounting the light reflector to a light fixture.

14. The light reflector according to claim 8, wherein said another plurality of integrally connected light reflecting segments include at least one cutout to facilitate mounting a lamp adjacent to said another plurality of integrally connected light reflecting segments.

15. In combination with a light fixture, a light reflector comprising:

a pair of spaced apart wings, each wing including a plurality of integrally connected light reflecting segments separated by fold lines; and another plurality of integrally connected light reflecting segments separated by fold lines, said another plurality of integrally connected light reflecting segments being bracketed laterally by said pair of spaced apart wings.

16. The combination according to claim 15, wherein at least some of said plurality of integrally connected light reflecting segments are of different sizes and shapes and are bent at their fold lines to form a generally curved configuration.

17. The combination according to claim 15, wherein said another plurality of integrally connected light reflecting segments separated by fold lines are bent at their fold lines to form another generally curved configuration.

18. The combination according to claim 15, wherein said another plurality of integrally connected light reflecting segments include at least one cutout to facilitate mounting the light reflector to the light fixture.

19. The combination according to claim 15, wherein said another plurality of integrally connected light reflecting segments include at least one cutout to facilitate mounting a lamp adjacent to both said plurality of integrally connected light reflecting segments and said another plurality of integrally connected light reflecting segments.

20. The light reflector according to claim 15, wherein said plurality of integrally connected light reflecting segments separated by fold lines and said pair of wings are connected to one another.

21. A light reflector comprising:

a pair of spaced apart wings; and a plurality of integrally connected light reflecting segments separated by fold lines, said plurality of integrally connected light reflecting segments being arranged in rows and bracketed laterally by said pair of spaced apart wings.

22. The light reflector according to claim 21, wherein said wings are curved.

23. The light reflector according to claim 22, wherein each wing includes a plurality of contiguous light reflecting surfaces.

24. The light reflector according to claim 23, wherein said plurality of contiguous light reflecting surfaces are disposed at different angles relative to one another.

25. The light reflector according to claim 21, wherein said wings are reflective.

26. The light reflector according to claim 21, wherein said plurality of integrally connected tight reflecting segments have different sizes and shapes.

27. The light reflector according to claim 21, wherein said pair of spaced apart wings and said plurality of integrally connected light reflecting segments are connected to one another.

28. The light reflector according to claim 21, wherein said pair of spaced apart wings and said plurality of integrally connected light reflecting segments are formed from a single sheet of metal.

29. The light reflector according to claim 21, wherein said pair of spaced apart wings and said plurality of integrally connected light reflecting segments are formed into a shell shape.

30. The light reflector according to claim 21, wherein said plurality of integrally connected light reflecting segments form a curved reflective surface.

31. A light reflector, comprising:

a pair of spaced apart light reflecting members; and at least one row of light reflecting segments bracketed laterally by said pair of spaced apart light reflecting members.

32. The light reflector according to claim 31, wherein said at least one row of light reflecting segments form a curved reflective surface.

33. The light reflector according to claim 31, wherein said pair of spaced apart light reflecting members and said at least one row of light reflecting segments are integrally connected to one another.

34. The light reflector according to claim 31, wherein said pair of spaced apart light reflecting members are light reflecting wings.

35. The light reflector according to claim 31, wherein said pair of spaced apart light reflecting members are light reflecting walls.

36. A light reflector, comprising:

a pair of spaced apart light reflecting wings; and at least one series of reflective segments bracketed by said pair of spaced apart light reflecting wings.

37. The light reflector according to claim 36 wherein said at least one series of reflective segments is a reflective plate.

38. The light reflector according to claim 37, wherein said reflective plate is curved; and wherein said series of reflective segments are separated by fold lines.

39. The light reflector according to claim 36, wherein said pair of spaced apart light reflecting wings include a plurality of contiguous light reflecting surfaces.

40. The light reflector according to claim 39, wherein at least some of said plurality of contiguous light reflecting surfaces are disposed at different angles relative to one another.

* * * * *